US006527524B2

(12) United States Patent
Cook

(10) Patent No.: US 6,527,524 B2
(45) Date of Patent: Mar. 4, 2003

(54) DOUBLE ACTING SIMPLEX PLUNGER PUMP WITH BI-DIRECTIONAL VALVES

(75) Inventor: James E. Cook, Anoka, MN (US)

(73) Assignee: Pumptec, Inc., Anoka, MN (US)

( * ) Notice: Subject to any disclaimer, the term of this patent is extended or adjusted under 35 U.S.C. 154(b) by 0 days.

(21) Appl. No.: 09/883,802

(22) Filed: Jun. 19, 2001

(65) Prior Publication Data

US 2002/0192091 A1 Dec. 19, 2002

(51) Int. Cl.[7] ..... F04B 39/00; F04B 39/10; F16K 15/00

(52) U.S. Cl. ..... 417/454; 417/534; 417/559; 137/535

(58) Field of Search ..... 417/454, 534, 417/559; 137/535, 540, 543.17

(56) References Cited

U.S. PATENT DOCUMENTS 1,003,479 A * 9/1911 Lucas ..... 137/540
2,002,783 A * 5/1935 Long ..... 251/127
3,410,477 A * 11/1968 Hartley ..... 230/185
3,664,770 A * 5/1972 Palmer ..... 417/383
4,026,196 A * 5/1977 Olofsson ..... 417/534
4,317,468 A * 3/1982 Schwartz et al. ..... 137/540
4,350,179 A * 9/1982 Bunn et al. ..... 137/246.12
5,102,312 A * 4/1992 Harvey ..... 417/569
5,173,039 A 12/1992 Cook
5,183,396 A 2/1993 Cook et al.

* cited by examiner

*Primary Examiner*—Charles G. Freay
*Assistant Examiner*—Timothy P. Solak
(74) *Attorney, Agent, or Firm*—Roger W. Jenson

(57) ABSTRACT

A bi-directional fluid valve apparatus comprising a valve member adapted to co-act with an annular shoulder at the end of a fluid bore, the valve member having two axial ends. A flat surface on a first end having a diameter greater than that of the shoulder is positioned with the flat surface abutting the axial end surface of the shoulder. At least two axially extending and circumferentially spaced apart ribs are on the second axial end thereof, each of the ribs terminating in an end surface. The ribs are positioned so that the end surfaces are in axial alignment with, and spaced a preselected distance from, the axial end surface of the shoulder. Hollow coil spring means are positioned within the recesses in register with the bores, and having a first end engaging one of the shoulders, and a second end engaging the at least three circumferentially spaced apart ribs and the second axial end of the valve member.

11 Claims, 4 Drawing Sheets

X-AXIS
Z-AXIS 10
12
12A
13
14
15
18
18A
18B
19
19'
20
20'
21
22
23
24
24'
25
27
27'
30
30'
31
31'
35
36
37
38
39
40
40'
41
41'
42
42'
45
45'
46
46'
47
48
48'
48''
50
AA
YY
X
Y
Z (ALTERNATE)

(ALTERNATE)

(ALTERNATE)

DOUBLE ACTING SIMPLEX PLUNGER PUMP WITH BI-DIRECTIONAL VALVES

BACKGROUND OF THE INVENTION

This invention provides a unique bi-directional fluid valve apparatus which has widespread utility and is especially adaptable, among other applications, to a double acting simplex plunger pump of the type disclosed in prior U.S. Pat. Nos. 5,173,039 and 5,183,396, the disclosures of which are incorporated herein by reference. Both of these patents, in FIG. 11 thereof, disclose check valves 66, and FIG. 4 thereof show check valves 66 and 67 arranged in reversed senses to provide bi-directional valving function. Check valves 66 and 67 are relatively expensive in comparison to the unique check valve provided by the instant application.

SUMMARY OF THE INVENTION

The present invention provides an improved reversible check valve for bi-directional fluid valve apparatus and has the following advantages over the check valves 66 and 67 shown in U.S. Pat. Nos. '039 and '396: The prior art check valves had adequate functionality but the four parts thereof made them relatively expensive, at least twenty (20) times more expensive than the unique check valve taught by this application, which is also characterized by its incredible simplicity, reversibility, versatility, quicker response, efficiency, quietness of operation, and adaptability to provide variations in the rate of flow of fluids therethrough by having a family of valve members, each member having a different preselected axial length so as to vary the axial travel of the member and thus accommodate a predetermined flow, or vary the flow rate of fluid passing through the valve.

In broad terms, the present invention provides a reversible bi-directional fluid valve apparatus to be used in combination with a head member having a flat manifold-engaging surface and a manifold member having a flat surface. The two members are connected together with the flat surfaces in abutting relationship. Each of the members has an identical bore therein substantially normal to the abutting flat surfaces, the bores being in axial alignment and each of the members having an identical recess around its respective bore and defining a shoulder having an axial end surface spaced from the abutting surfaces the same preselected distance. The shoulders have identical preselected transverse dimensions. The valve apparatus further comprises a valve member having two axial ends with a flat surface on a first of said axial ends with preselected transverse dimensions greater than said preselected transverse dimensions of the shoulders, positioned with said flat surface thereof abutting the axial end surface of one of the shoulders. The valve member further includes at least two axially extending and circumferentially spaced apart ribs on a second axial end thereof. Each of the ribs is of the same preselected axial length and terminates in an end surface. The ribs are positioned so that the end surfaces thereof are in axial alignment with. and are spaced a preselected distance from, the axial end surface of the other of the shoulders. The valve apparatus further comprises hollow coil spring means positioned within said recesses in register with the bores and having two ends: a first end sized to engage the other shoulder, and a second end of identical dimension sized to engage said second axial end of the valve member above the ribs. The spring means is selected so that it will bias the flat surface of the valve member towards the axial end surface of one of the shoulders so as to provide a closed valve function. Further, the spring is selected so as to yield under applied force to permit axial travel of the valve a limited distance to a position whereat said end surfaces of said ribs are in engagement with the axial end surface of the other shoulder, to provide an open valve function of predetermined area.

The foregoing valve apparatus in a more limited sense is characterized by the bores, recesses, shoulders and valve member all having a circular cross section and the spring means being cylindrical with a circular cross section.

In a more limited sense, my unique valve apparatus is provided in combination with a double acting simplex plunger pump apparatus to provide an improved pump.

DETAILED DESCRIPTION OF THE INVENTION

Figures 1, 2, 3, 4, 5:
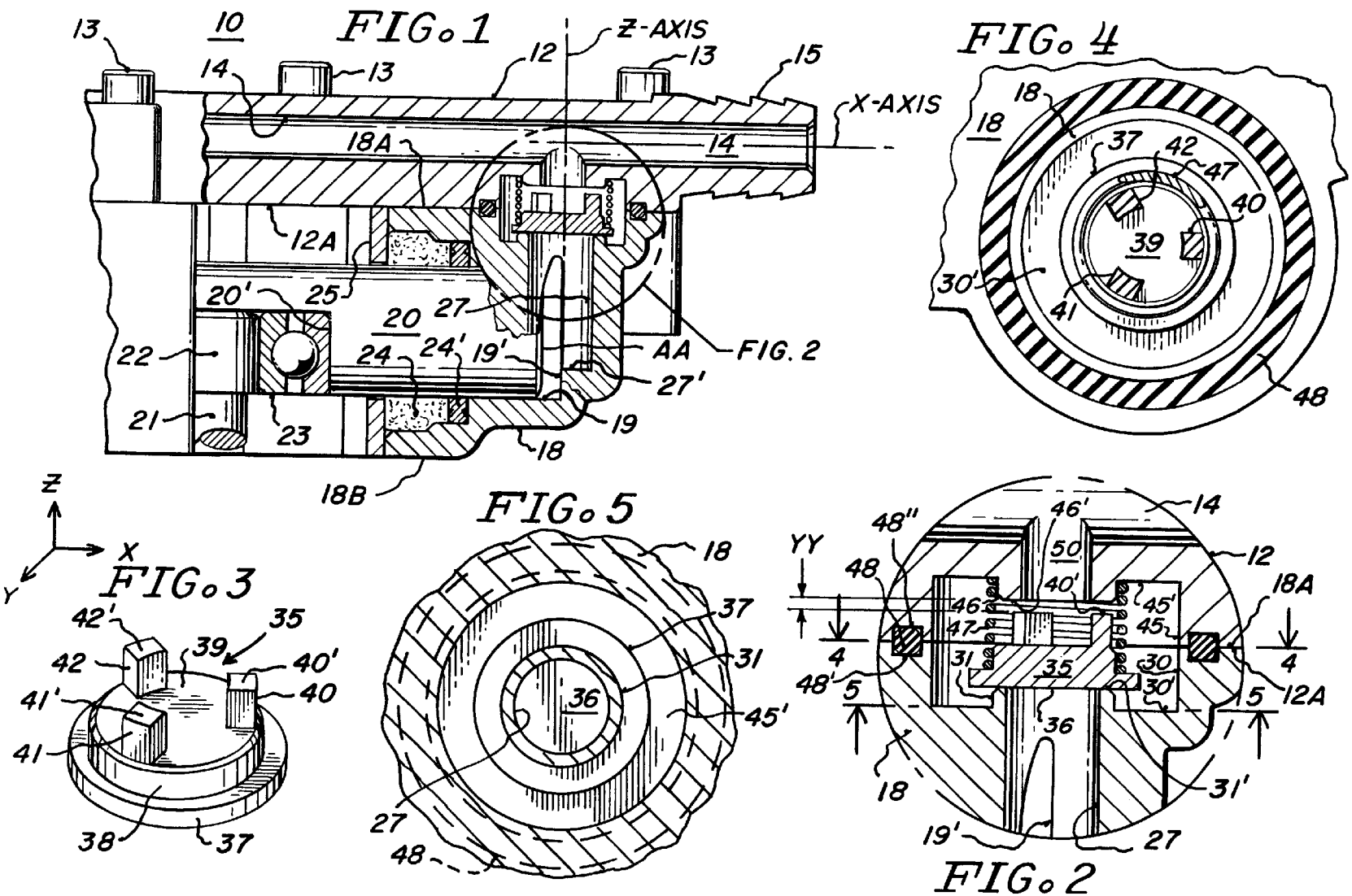
FIG. 1 is a portion of a double acting simplex plunger pump with a portion thereof in section.
FIG. 2 is an enlargement of the unique valve structure shown in FIG. 1.
FIG. 3 is an isometric view of an example of my unique valve member. This figure also shows three mutually perpendicular reference axes: X, Y, and Z, respectively, sometimes hereinafter termed longitudinal, transverse, and vertical.
FIG. 4 is a view of the apparatus shown in FIG. 2 as viewed along section lines 4—4.
FIG. 5 is a view of the apparatus shown in FIG. 2 as viewed along section lines 5—5.

In FIG. 1, the reference numeral 10 generally designates a double acting simplex plunger pump comprising a manifold 12 and first and second unitary combined stuffing box and head or block members, only one of which 18 is depicted in FIG. 1. Block 18 has two spaced apart and parallel surfaces 18A and 18B, respectively designated a motor end face engaging surface, and a pump manifold engaging surface. A recess 19 is provided in the block 18 for receiving one end of a cylindrically-shaped plunger 20, recess 19 having a circular cross-section and a longitudinal axis lying parallel to and in between aforementioned flat parallel surfaces 18A and 18B.

The plunger is caused to reciprocate along the longitudinal axis thereof under the influence of an eccentric arrangement including a drive shaft 21 from a motor (not shown) and eccentric 22 housed within the inner race of a bearing 23 set within a notch 20' in the plunger 20, all as is discussed in more detail in my above-mentioned patents. A guide 24 and packing 24' is provided to provide guide, lubrication, and a seal for the plunger 20. The guide and packing is retained by a metal plate member 25. The axial end of the longitudinally extending bore 19 is identified by reference numeral 19' and recess 19 is connected to a vertically extending bore 27 which extends from the surface 18A normal to the surface thereof, and terminates at an end 27' as is clearly shown in FIG. 1.

Figure 9:
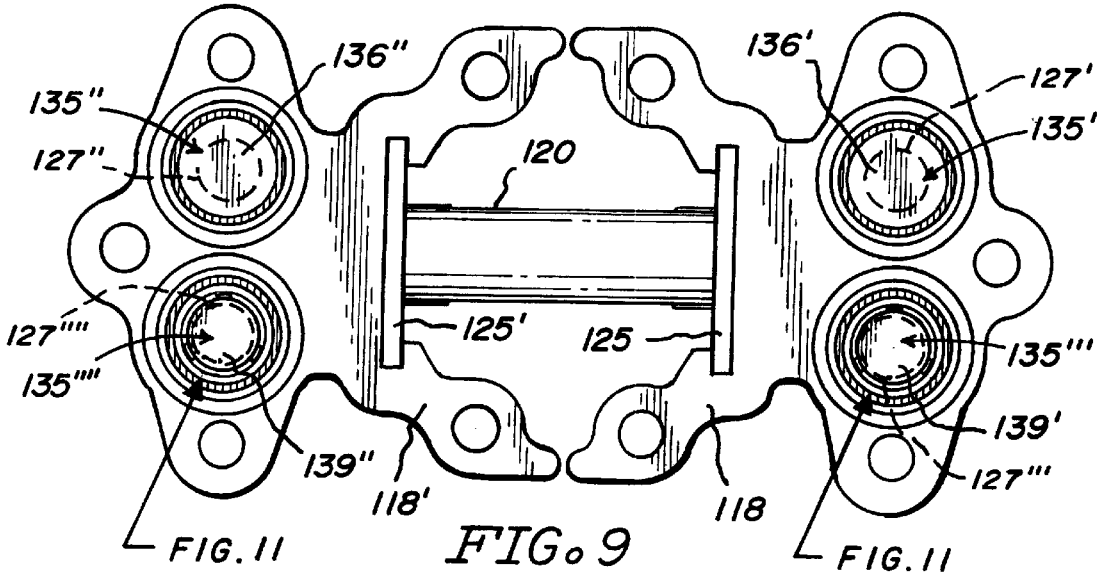
FIG. 9 is a view of the first and second unitary combined stuffing box and head members as viewed along section lines 9—9 of FIG. 8.

Each block member has a pair of transversely spaced apart parallel bores; as indicated, only one of block member 18's bore 27 is shown in FIG. 1. Each pair of bores is hereinafter termed a "set" of first and second transversely spaced apart pump ports; also, each port is in connective relationship with the recess 19, so that fluid pumped by the reciprocating plunger 20 will flow through said ports, all as described in more detail below. FIG. 9 shows two similar blocks 118 and 118' as a subassembly where four ports 127'–127"" (similar to port 27) are shown in dotted line fashion, each being obscured in this view by valve members 135'–135"" also described below. FIG. 9 thus shows two longitudinally spaced apart sets of transversely spaced apart ports.

Figure 10:
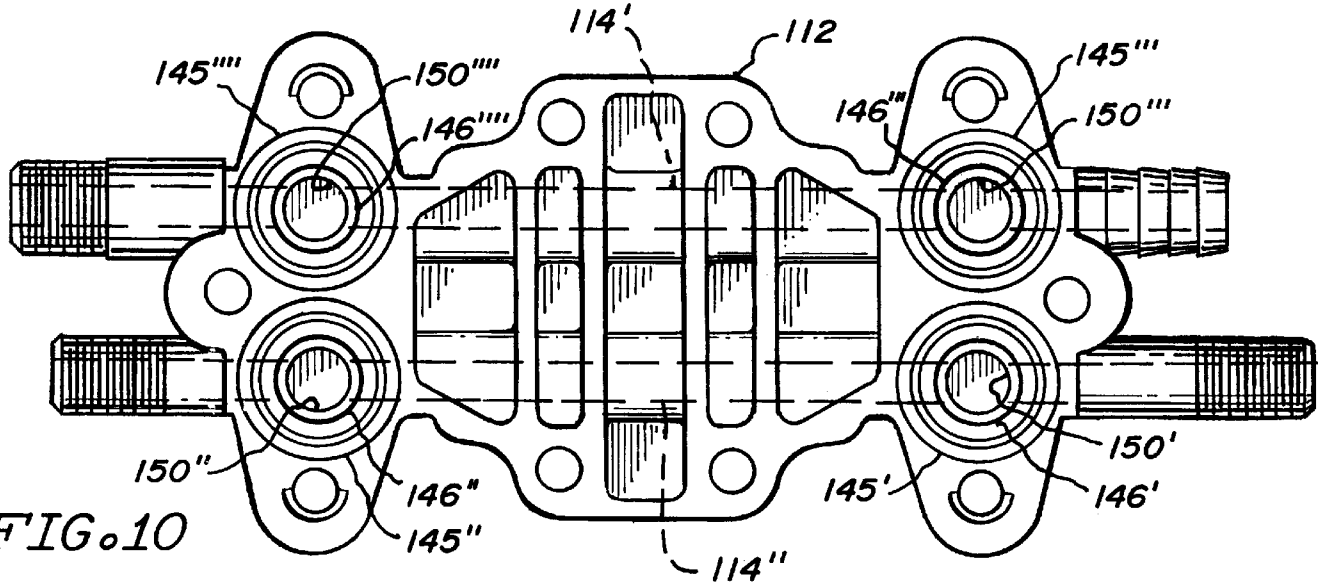
FIG. 10 is a view of the manifold member as viewed along section lines 10—10 of FIG. 8.

The manifold 12 has a longitudinal axis and a bottom flat surface 12A adapted to be abutted by said pump manifold engaging surfaces 18A of the head members. The manifold further comprises first and second transversely-spaced-apart manifold inlet/outlet bores extending longitudinally therethrough from a first end to a second end, and being mutually parallel to the longitudinal or X axis; one of these inlet/outlet bores 14 is depicted in FIG. 1, and reference may be made to the aforementioned U.S. Pat. No. 5,183,396, at FIG. 5 showing a pair of similar inlet/outlet bores 55 and 66. See also FIG. 10 for a showing of manifold inlet/outlet bores 114' and 114". The manifold further comprises first and second longitudinally-spaced-apart sets of transversely-spaced-apart ports connecting the manifold inlet/outlet bores to the bottom flat surface of the manifold; only one of the last-mentioned ports 50 being depicted in FIG. 2, but four similar ports are shown in FIG. 10, wherein the ports are identified by reference numerals 150'–150"".

Each of the pump ports of the blocks and said manifold ports are encircled by a concentrically positioned annular recess, e.g., recesses 30 and 45 shown in FIG. 2. Each recess defines an annular shoulder, e.g., shoulders 31 and 46 of FIG. 2. Each annular shoulder has an axial end surface (e.g., surfaces 31' and 46' of FIG. 2) spaced a preselected distance respectively from said pump-manifold engaging surface 18A and said bottom flat surface 12A; this preselected dimension is identified in FIG. 2A by the symbol "d". Further, the shoulders have substantially the same or equal outside diameters, i.e., transverse dimensions.

The combined stuffing box and head member 18 and the manifold member 12 are shown in FIG. 1 connected, using appropriate means such as machine screws 13 coacting with threaded means not shown, the flat bottom surface 12A of the manifold being abutted by the pump-manifold engaging surface 18A of the combined stuffing box and head member. The connected members 12 and 18 have the vertically (Z axis) oriented bores encircling recesses and shoulders in respective axial register or alignment as is shown in FIG. 2. For example, recesses 30 and 45, when abutted as shown in FIG. 2, form a combined recess volume for receiving a valve assembly. Before the manifold 12 is assembled with the head members as aforesaid, the unique valve members are positioned as assemblies within the combined recesses formed by the assembled members. More specifically, as is shown in FIGS. 2–5, the unique valve assembly comprises valve member 35 having a circular cross-section with two axial ends 36 and 39, and a rim 37 having a diameter greater than that of the outside diameter of the annular shoulders. The valve member 35 as shown in FIG. 2 has a bottom flat surface 36, i.e., a flat surface on a first axial end thereof, and at least two axially-extending and circumferentially-spaced-apart ribs on a second axial end 39 thereof. Three ribs are provided in the illustrated embodiment for stability, as is best shown in FIG. 3. The aforesaid rim 37 at the first axial end is shown; inboard of rim 37 is a hub or shoulder 38 of reduced diameter which is preselected so as to fit within the coil spring 47 to be discussed below. Projecting or extending axially from hub 38 are legs or ribs 40, 41, and 42 which are circumferentially spaced apart from one another, and each terminating in a flat surface 40', 41', and 42' respectively. The ribs all have the same preselected axial length ending in the aforesaid end surfaces 40', 41', and 42'. When the valve member 35 is positioned in the annular recesses it will be noted that the legs 40–42 are in axial alignment (along the Z axis) with the axial end surface 46' of shoulder 46 of the manifold 12.

The members 12 and 18 have suitable gaskets or the equivalent around each of the aligned bores; for example, FIG. 2 shows a pair of opposed annular recesses 48' and 48" in register to form an annular housing for an annular "O" ring 48.

Each pump comprises four identical hollow cylindrical coil springs; one 47 of which is shown in FIGS. 1 and 2, the springs being positioned respectively within said combined annular recesses concentrically with the bores. Each spring has two ends, namely a first end sized to snugly fit around one of the annular shoulders; this is depicted in FIG. 2, wherein the spring 47 is snugly fit around the shoulder 46 of manifold 12. The second end of the spring is sized to snugly fit around the spaced-apart ribs 40–42; this too is depicted in FIG. 2, and more specifically would be snugly around the hub 38 as is best shown in FIG. 3.

As indicated, the valve means can operate as a check valve, and this is the preferred utilization in the double acting simplex plunger pump disclosed. More specifically, as shown in FIG. 2, the valve member 35 is at rest, sealing off port 27 under the influence of pressure in port 50.

Figure 2A:
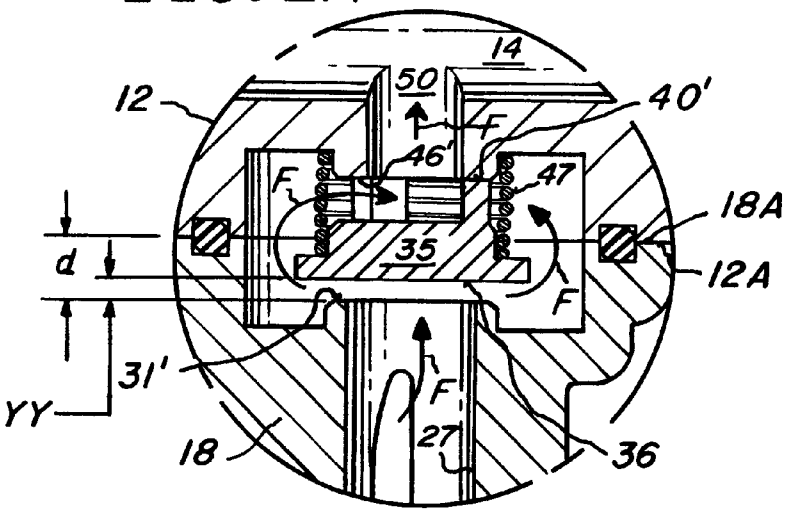
FIG. 2A is a showing of the check valve shown in FIG. 2, but with the spring 47 compressed, i.e., yielding under the force of the fluid, to allow the flow of fluid therethrough.

FIG. 2A depicts the valve 35 moved upwardly as shown, away from surface 31' of shoulder 31 under the influence of a sufficiently high pressure in port 27. When this pressure exceeds a preselected level, then the spring 47 yields under the applied force of the pressure acting against surface 36 on the underside or first axial end of the valve 35. The valve 35 travels upwardly as shown in FIG. 2A a limited distance YY, the travel being terminated when the ends surfaces 40', 41', and 42' of the valve abut against the axial end surface 46' of shoulder 46. It can be seen that the flow of the fluid, designated by the letter F and its corresponding arrows, is upwardly through and out port 27, thence flowing radially around on all sides of the valve 35, through the coils of spring 47 and legs 40–42, and thence upwardly through port 50.

In broad terms, therefore, the valve means depicted in FIGS. 1 and 2, etc., function as a check valve, the check valve operating point being a function of the spring characteristics, to yield under a greater pressure being applied to the underside 36 of the valve member to permit fluid flow.

The dimensions of the recess and the valve members are extremely important to the operation of the valve in controlling fluid flow. A first critical dimension is the axial length of the valve, i.e., the distance from the flat face on one axial end of the valve to the end surface of the ribs or legs of the valve; an example of this is designated "XX" in FIG. 12. A second is the distance from the aforesaid abutted surfaces 12A and 18A to the axial ends of the shoulders; see reference "d" in FIG. 2A. When the members 12 and 18 are connected as shown, the axial distance between the axial ends 31' and 46' of opposed shoulders 31 and 46 is 2*d*. When a valve member of axial length XX is positioned as shown in FIG. 2, a gap or spacing "YY" is defined between the axial end surfaces of the ribs and the axial end surface of the opposing shoulder. Dimension YY thus defines the maximum axial travel permitted for the valve as is shown in FIG. 2A; this is very important as will be understood by those skilled in the art. In an optimum design "YY" will be selected to provide the desired fluid flow rate; if the actual "YY" is larger than necessary the unnecessary extra axial travel may introduce a reduction in response time for no further increase in flow. The selection of the dimension "YY" thus provides a means for obtaining a precise flow rate, this provides the valve designer a powerful design tool.

Another variable is the sector width of the ribs in relationship to the circumferential spacing of the ribs; as shown in FIG. 2A the fluid flow paths F exit port 27, enter the combined recess, traverse between the coils of spring 47, and thence between the ribs into manifold port 50.

Figure 7:
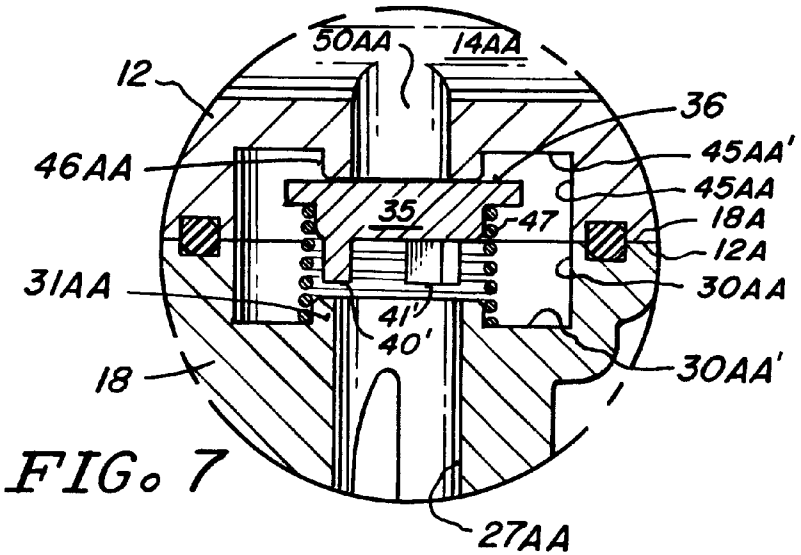
FIG. 7 is a showing of the valve apparatus shown in FIGS. 1 and 2, but with the valve member reversed so as to act as a fluid check valve in a flow direction opposite from the direction controlled by the apparatus of FIGS. 1 and 2.

FIG. 7 is an illustration of how the valve member 35 and its associated spring may be inverted from the positions shown in FIGS. 2 and 2A so as to provide the same check valve functions and other functions as before, but in a reverse sense.

Figure 11:
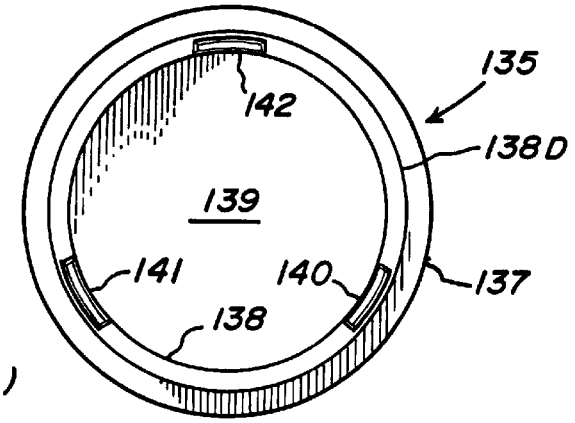
FIG. 11 is a plan view of a preferred embodiment of my valve member.
Figure 12:
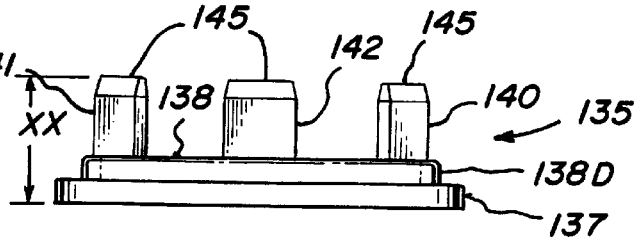
FIG. 12 is a side view of the valve member shown in FIG. 11.

The preferred form or embodiment of the valve member is shown in FIGS. 11 and 12, wherein the entire valve member is identified by reference numeral 135, comprising a cylindrically-shaped valve member having a circular cross-section with a diameter greater than that of the outside diameter of the annular shoulders. More specifically, the valve member 135 has a rim 137, the diameter of which is greater than that of the outside diameter of the shoulders, e.g., shoulder 31 and a first axial end 136. An annular-shaped shoulder 138 has a preselected outside diameter 138D which is preselected so as to fit snugly within the coil spring 47. The annular shoulder 138 has limited axial extent and serves as a mount for at least two axially extending and circumferentially spaced apart ribs; three ribs, 140, 141, and 142, are depicted. The second axial end 139 of valve 135 is shown in FIG. 11. Each of the ribs 140–142 has the same preselected axial length and terminates in an end surface 145. The diameter of annular shoulder 135 and thus the diameter of the circumferentially-spaced-apart ribs 140–142 is selected to be substantially the same as the axial end surface of the shoulders, e.g., shoulder surface 31' shown in FIG. 2.

The pump heads, manifolds and valves 35 and 135 may be formed from any suitable material such as plastic or metal.

In FIG. 9, four of the preferred valve members 135 are shown in position in blocks 118 and 118', and are respectively identified by reference numerals 135', 135", 135'", and 135"". More specifically, at the right end of the apparatus as shown in FIG. 9, valve 135' is positioned with its flat face 136' exposed to the viewer, and its associated transversely-spaced-apart valve 135'" is positioned so that the ribs or legs and the second axial face 139' are facing the viewer.

In the same manner, at the left-hand end of the apparatus shown in FIG. 9, the valve 135" is positioned with its flat axial face 136" facing the viewer, and its transversely-spaced-apart valve 135"" is positioned so that the ribs or legs and the face 139" face the viewer.

Figure 8:
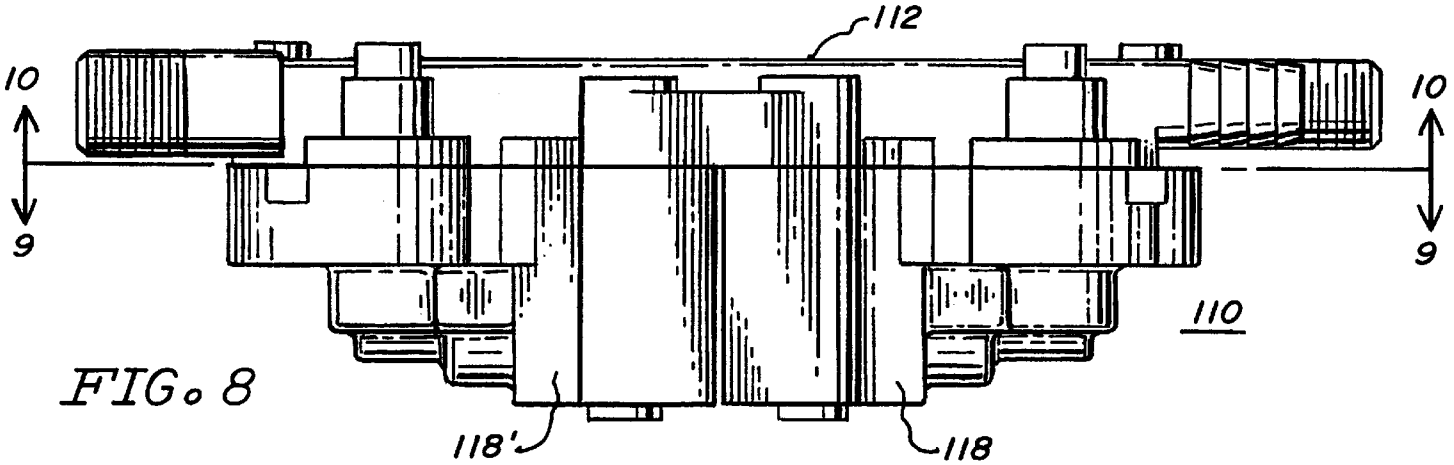
FIG. 8 is a side view of the exterior of a complete double acting simplex plunger pump.

FIG. 10 depicts the flat bottom surface of the manifold as viewed along section lines 10—10 of FIG. 8. The first and second transversely spaced apart manifold inlet/outlet bores 114' and 114" are shown in phantom to be extending longitudinally therethrough from a first end to a second end, and being mutually parallel to said longitudinal axis X. A first set of transversely spaced apart ports 150' and 150'" are depicted at the right end of the figure as shown, and a second set of transversely spaced apart ports 150" and 150"" are shown of the left side of the figure as shown. Thus, FIG. 10 depicts, for the manifold, first and second longitudinally spaced apart sets of transversely spaced apart ports connecting the manifold inlet/outlet bores to the bottom flat face. Each of the pump ports of the blocks, and the said manifold ports, are circled by a concentrically positioned annular recess. Thus, for the manifold, the recesses are respectively identified by reference numerals 140'–145"", the recesses in turn defining shoulders 146'–146"" respectively.

As indicated, the ports 150'–150"" are positioned so as to be exactly in register with the ports and valve depicted in the blocks shown in FIG. 9.

Figure 6:
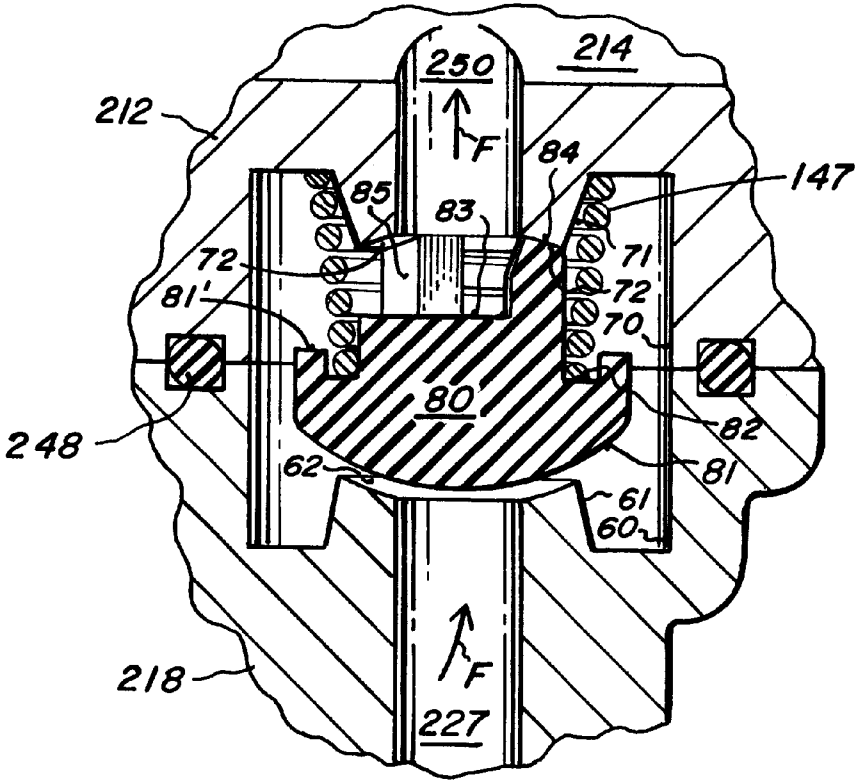
FIG. 6 is a view of an alternate form of the valve member.

FIG. 6 shows another alternate form of valve member which may be used with the apparatus shown in FIGS. 8–10. Again, a head member 218 has a flat surface adapted to be abutted against a flat surface of a manifold member 212. The head member has a recess 60 and the manifold member has a recess 70 which are concentric with ports 227 and 250 respectively, and which define shoulders 61 and 71, the opposing axial faces, 62 and 72 respectively, of which are curved to match the curvature of one axial end 81 of a valve member 80 which may be made of a suitable material such as plastic or rubber. Valve 80 is shown in cross-section in FIG. 6, having a curved surface 81 as aforesaid for abutting against the curved axial end surface of the shoulder 61 as shown in FIG. 6 (or against the curved surface 72 if the apparatus were reversed). The valve member 80 further has an axially extending annular shoulder 81' defined by an annular groove 82 to provide a seat for one end of a spring 147. Spring 147 is shown to be a coil spring, one end of which is seated in the annular recess 82 and the other end of which is abutted against the axial end or bottom of the recess 70 as shown in FIG. 6. The valve 80, as shown in FIG. 6, has been displaced upwardly, causing the spring 147 to yield under fluid pressure applied to face 81 of valve 80, and thus provide a gap, or flow space, for fluid to flow upwardly through port 227 as shown, and thence around the valve member 80, through the coils of the spring 147 to flow outwardly through port 250. The upward travel of the valve 80 is limited by one or more axially-extending legs 84 which extend axially from a baseline 83 on the valve 80, the ends of which abut against the curved valve seat surfaces 72 and 62.

In summary, the present invention provides an unique reversible valve member, in combination with the above described identical bores, recesses, shoulders, and shoulder axial end faces. The biasing and centering springs are dual function: they simultaneously function as a spring retainer allowing a limited amount of axial travel of the valve while retaining or stabilizing the valve against travel in the transverse (X and Y axes) direction. Further the springs are preselected to have a desired stiffness so as to yield to permit the aforesaid axial travel at a preselected pressure in the bore with respect to which the valve is abutting.

The annular shoulders also are multifunctional. While one opposed shoulder is functioning as a seat (and thus a retainer) for one end of the coil spring, the other opposed shoulder is functioning as a valve seat. Further the axial end surfaces of the shoulders serve to limit the amount of axial travel of the valves to the dimension YY, regard being given to the axial length XX of the valve, and the total axial dimension 2d between the opposed axial end surfaces of the opposed shoulders.

As indicated, the minimum number of ribs or legs on the valve members is two; however the preferred embodiments of the invention shown in the drawings comprise three legs or ribs spaced apart circumferentially approximately equally; this provides valve operational stability. Of course, more than three ribs could be used; this would be within the scope of the invention.

While the preferred embodiment of the invention has been illustrated, it will be understood that variations may be made by those skilled in the art without departing from the inventive concept. Accordingly, the invention is to be limited only by the scope of the following claims.

I claim:

1. A bi-directional fluid valve apparatus comprising in part:

a. a head member having a flat manifold engaging surface;

b. a manifold member having a flat surface, said manifold member being connected to said head member with said flat surfaces in abutting relationship, each of said members having a bore therein substantially normal to said abutting flat surfaces, said bores being in axial alignment, and each of said members having a recess coaxial with its respective bore and defining a shoulder having an axial end surface spaced from said abutting surfaces the same preselected distance, said shoulders having substantially equal preselected transverse dimensions;

c. a valve member having two axial ends with a flat surface on a first of said axial ends and preselected transverse dimensions greater than said preselected transverse dimensions of said shoulders positioned with said flat surface thereof abutting said axial end surface of one of said shoulders, and at least two axially-extending and circumferentially-spaced-apart ribs on a second axial end thereof, each of said ribs having the same preselected axial length and terminating in an end surface, and said ribs being positioned so that said end surfaces thereof are in axial alignment with, and are spaced a preselected distance from, said axial end surface of the other of said shoulders; and d. hollow coil spring means positioned within said recesses and having two ends: a first end sized to engage said other shoulder and a second end sized to engage said at least two circumferentially-spaced-apart ribs and said second axial end of said valve member, said spring means being selected so that it will (i) bias said flat surface of said valve member toward said axial end surface of said one of said shoulders to provide a closed valve function, and (ii) yield under applied force to permit axial travel of said valve member a limited distance to a position whereat said end surfaces of said ribs are in engagement with the axial end surface of said other shoulder to provide an open valve function.

2. The valve apparatus of claim 1, further characterized by said bores, recesses, shoulders and valve members all having a circular cross section and said spring means being cylindrical with a circular cross section.

3. The valve apparatus of claim 1, wherein said spring means stabilizes and restrains said valve member from transverse movement.

4. A bi-directional fluid valve apparatus in combination with:

a head member having a flat manifold engaging surface; and a manifold member having a flat surface, said manifold member being connected to said head member with said flat surfaces in abutting relationship, each of said members having a bore therein substantially normal to said abutting flat surfaces, said bores being in axial alignment, and each of said members having a recess coaxial with its respective bore defining a shoulder having an axial end surface spaced from said abutting surfaces the same preselected distance, and said shoulders having substantially equal preselected transverse dimensions, said valve apparatus comprising:

a. a valve member having two axial ends, a flat surface on a first of said axial ends and preselected transverse dimensions greater than said preselected transverse dimensions of said shoulders, positioned with said flat surface thereof abutting said axial end surface of one of said shoulders, and at least two axially-extending and circumferentially-spaced-apart ribs on a second of said axial ends thereof, each of said ribs having the same preselected axial length and terminating in an end surface, and said ribs being positioned so that said end surfaces thereof are in axial alignment with, and are spaced a preselected distance from, said axial end surface of the other of said shoulders; and b. hollow coil spring means positioned within said recesses and having two ends: a first end sized to engage said other of said shoulders and a second end sized to engage said at least two circumferentially-spaced-apart ribs and said second axial end of said valve member, said spring means being selected so that it will (i) bias said flat surface of said valve member toward said axial end surface of said one of said shoulders to provide a closed valve function, and (ii) yield under applied force to permit axial travel of said valve member away from the axial end surface of said one of said shoulders to provide an open valve function.

5. The valve apparatus of claim 4, further characterized by said bores, recesses, shoulders and valve members all having a circular cross section and said spring means being cylindrical with a circular cross section.

6. The valve apparatus of claim 4, wherein said spring means stabilizes and restrains said valve member from transverse movement.

7. A double acting simplex plunger pump comprising in part:

a. a combined stuffing box and head member having a flat manifold engaging surface;

b. a manifold member having a flat surface, said manifold member being connected to said stuffing box and head member with said flat surfaces in abutting relationship, each of said members having a circular bore therein substantially normal to said abutting flat surfaces, said bores being in axial alignment, and each of said members having an annular recess concentric with its respective bore and defining an annular shoulder having an axial end surface spaced from said abutting surfaces the same preselected distance, said annular shoulders having substantially equal preselected outside diameters;

c. a cylindrically-shaped poppet valve member having a flat surface on a first axial end thereof and a preselected diameter greater than said outside diameter of said annular shoulders positioned with said flat surface thereof abutting said axial end surface of one of said annular shoulders, and at least two axially-extending and circumferentially-spaced-apart ribs on a second axial end thereof, each of said ribs having the same preselected axial length and terminating in a flat end surface and said ribs being positioned so that said flat end surfaces thereof are in axial alignment with, and are spaced a preselected distance from, said axial end surface of the other annular shoulder; and d. hollow cylindrical coil spring means positioned within said annular recesses concentrically with said bores and having two ends: a first end sized to fit around said other annular shoulder; and a second end sized to snugly fit around said at least two circumferentially-spaced-apart ribs and to engage said second axial end of said poppet valve member, said spring means being selected so that it will (i) bias said flat surface of said poppet valve member toward said axial end surface of said one of said annular shoulders to provide a closed valve function, and (ii) yield under applied force to permit axial travel of said poppet valve member a limited distance to a position whereat said flat end surfaces of said ribs are in engagement with the axial end surface of said other annular shoulder to provide an open valve function.

8. A double acting simplex plunger pump comprising in part:

a. first and second unitary combined stuffing box and head members, each of said members comprising (i) a unitary block having two spaced-apart and parallel surfaces respectively designated a motor end face engaging surface and a pump manifold engaging surface, (ii) a recess in said block for receiving a cylindrically shaped plunger, said recess having a circular cross-section and a longitudinal axis lying parallel to and in between said spaced-apart parallel surfaces, and (iii) a set of first and second transversely spaced apart pump ports in said block and each extending from said pump manifold engaging surface into said block and into connective relationship with said plunger receiving recess;

b. a manifold having a longitudinal axis, a bottom flat surface adapted to be abutted by said pump manifold engaging surfaces, first and second transversely spaced apart manifold inlet/outlet bores extending longitudinally therethrough from a first end to a second end and being mutually parallel to said longitudinal axis, and first and second longitudinally-spaced-apart sets of transversely spaced apart ports connecting said manifold inlet/outlet bores to said bottom flat surface, each of said pump ports of said blocks and said manifold bores being encircled by a concentrically-positioned annular recess defining an annular shoulder having an axial end surface spaced a preselected distance respectively from said pump manifold-engaging surface and said bottom flat surface, and said annular shoulders having substantially equal outside diameters;

c. means connecting said members to said manifold whereby said bottom flat surface abuts said pump-manifold-engaging surfaces of said members and said two sets of first and second pump ports and said encircled recesses of said members are respectively in register with said first and second longitudinally-spaced-apart sets of ports and said encircled recesses of said manifold;

d. four cylindrically shaped identical valve members each having a circular cross section with a diameter greater than that of said outside diameter of said annular shoulders, a flat surface on a first axial end thereof, and at least two axially-extending and circumferentially-spaced-apart ribs on a second axial end thereof, each of said ribs having the same preselected axial length and terminating in an end surface, said valve members being respectively positioned in said annular recesses so that said flat surfaces of two of said valves are abutting said axial end surfaces of said annular shoulders in said manifold and so that said flat surfaces of the other two of said valves are abutting said axial end surfaces of said annular shoulders in said members, said end surfaces of said ribs being in axial alignment with, and spaced a preselected distance from, said axial end surface of the other annular shoulder; and e. four hollow cylindrical coil spring means positioned respectively within said annular recesses concentrically with said bores and each having two ends: a first end sized to fit around one of said annular shoulders and a second end sized to fit around said at least two circumferentially spaced apart ribs and to engage said second axial end of said valve members, said spring means having preselected characteristics so that it will bias said flat surfaces against their respective axial end surfaces of said shoulders to provide a closed valve function, and to yield under applied force to permit axial travel of said valve members for a limited distance to a position whereat said end surfaces of said ribs are in engagement with the axial end surface of their adjacent axial end surfaces of said shoulders to provide an open valve function.

9. A bi-directional fluid valve apparatus comprising in part:

a. a head member having a flat manifold engaging surface;

b. a manifold member having a flat surface, said manifold member being connected to said head member with said flat surfaces in abutting relationship, each of said members having a bore therein substantially normal to said abutting flat surfaces, said bores being in axial alignment, and each of said members having a recess around its respective bore and defining a shoulder having a curved axial end surface spaced from said abutting surfaces the same distance, said annular shoulders having substantially equal preselected transverse dimensions;

c. a valve member having two axial ends with a preselected curved surface on a first of said axial ends and transverse dimensions greater than said transverse dimensions of said shoulders positioned with said curved surface thereof abutting said axial end surface of one of said shoulders, said valve member further having an intermediate annular recess, and at least two axially-extending and circumferentially-spaced-apart ribs on a second axial end thereof, each of said ribs having the same axial length and terminating in an end surface, and said ribs being positioned so that said end surfaces thereof are in axial alignment with, and are spaced a distance from, said axial end surface of the other of said shoulders; and d. hollow coil spring means positioned within said recesses and having two ends: a first end sized to engage said other shoulder and a second end sized to engage said intermediate annular recess, said spring means being characterized so that it will (i) bias said valve member toward said axial end surface of said one of said shoulders to provide a closed valve function, and (ii) yield under applied force to permit axial travel of said valve member a limited distance to provide an open valve function.

10. The valve apparatus of claim 9, further characterized by said bores, recesses, shoulders and valve members all having a circular cross section and said spring means being cylindrical with a circular cross section.

11. The valve apparatus of claim 9, wherein said spring means stabilizes and restrains said valve member from transverse movement.

* * * * *